US005435105A

United States Patent [19]

Visser

[11] Patent Number: 5,435,105

[45] Date of Patent: Jul. 25, 1995

[54] GUTTERING SYSTEM

[75] Inventor: Timon J. Visser, Hamilton, Australia

[73] Assignee: Vishill-Tech (Patents) Pty. Limited, New South Wales, Australia

[21] Appl. No.: 688,579

[22] PCT Filed: Jan. 9, 1990

[86] PCT No.: PCT/AU90/00006

§ 371 Date: Jun. 26, 1991

§ 102(e) Date: Jun. 26, 1991

[87] PCT Pub. No.: WO90/07619

PCT Pub. Date: Jul. 12, 1990

[30] Foreign Application Priority Data

Jan. 9, 1989 [AU] Australia ..... PJ2203

[51] Int. Cl.[6] ..... E04D 13/06

[52] U.S. Cl. ..... 52/12; 52/14

[58] Field of Search ..... 52/11, 12, 13, 14

[56] References Cited

U.S. PATENT DOCUMENTS

| | | | |
|---|---|---|---|
| 1,002,611 | 9/1911 | Wagner | 52/12 |
| 3,611,731 | 10/1971 | Edmondson | 52/11 |
| 3,667,717 | 6/1972 | Fasth | 52/11 |
| 4,257,716 | 3/1981 | Woodrow | 405/118 |
| 4,964,247 | 10/1990 | Spica | 52/12 |
| 5,010,696 | 4/1991 | Knittel | 52/12 |
| 5,038,528 | 8/1991 | Brant | 52/11 |

FOREIGN PATENT DOCUMENTS

| | | | |
|---|---|---|---|
| 34140 | 8/1981 | European Pat. Off. | 52/11 |
| 0122137 | 10/1978 | Japan | 52/11 |
| 0000379 | 1/1907 | United Kingdom | 52/11 |

*Primary Examiner*—Carl D. Friedman
*Assistant Examiner*—Robert Canfield
*Attorney, Agent, or Firm*—Beveridge, DeGrandi, Weilacher & Young

[57] ABSTRACT

A roof guttering system includes gutter portions which each have a bottom trough covered by a concave top trough. The top trough has apertures provided with strainers. Runoff initially is received in the top trough and then flows via the apertures and strainers into the bottom trough. The gutter portions may be joined by plug and socket connections to further guttering components as a modular assembly.

11 Claims, 2 Drawing Sheets

GUTTERING SYSTEM

Figure 1:
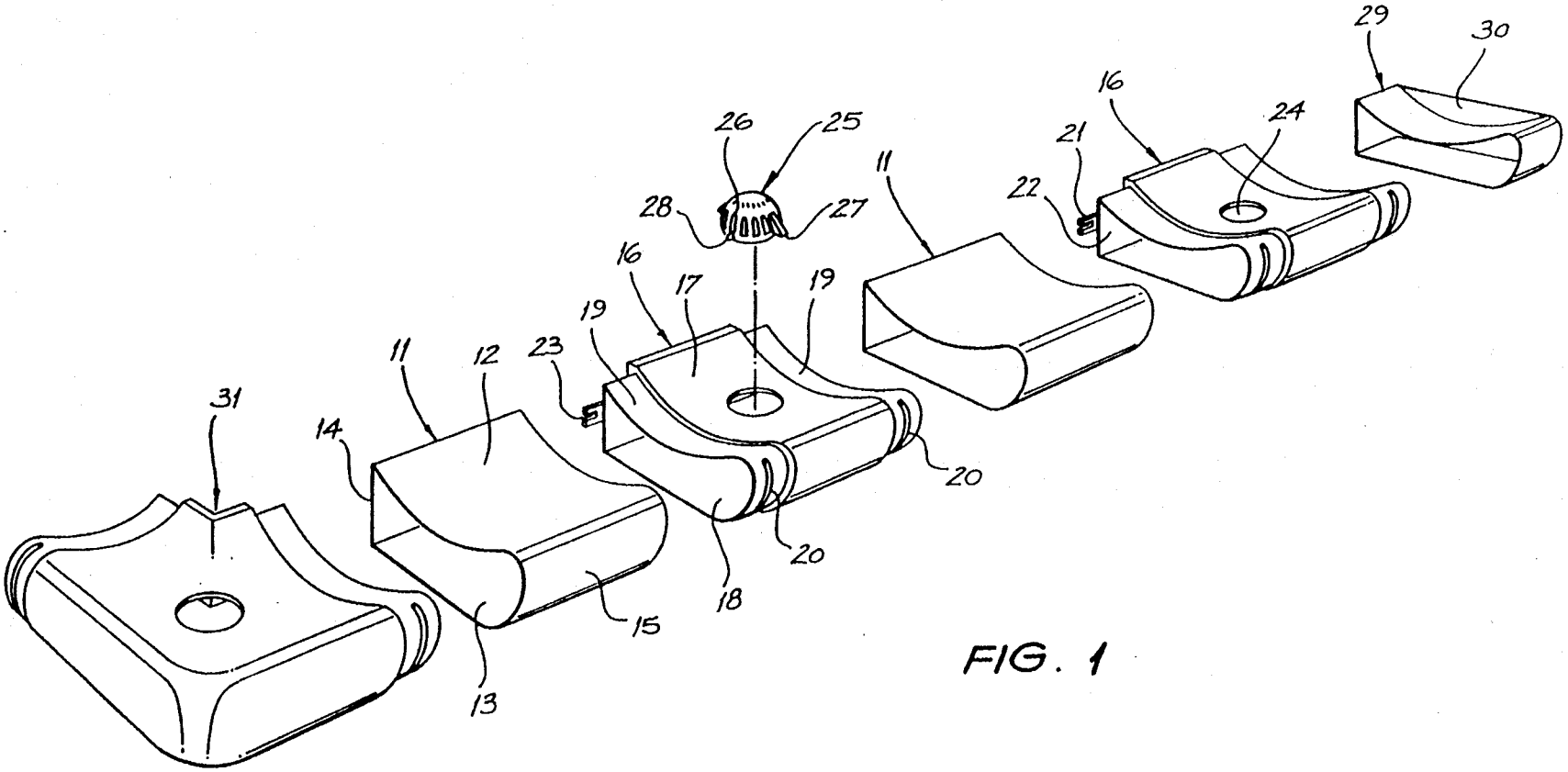

The present invention relates to guttering systems having a top trough which initially receives runoff and diverts this to a bottom trough which carries the runoff to an outlet. Any leaf matter on the top trough is prevented from entering the bottom trough.

A gutter of the type generally described above is disclosed in U.S. Pat. No. 3,436,878 to Singer. The Singer Patent describes a gutter having a leaf guard which is formed as a channel located above the gutter. The gutter and leaf guard are attached to a supporting surface by screws at locations spaced along the length of the gutter.

The leaf guard and gutter arrangement disclosed by Singer is time consuming to install. Furthermore, the perforations in the channel are designed to trap leaf matter, and require periodic cleaning.

One aspect of the present invention seeks to provide an improved guttering assembly or kit with increased ease of installation. Another aspect of the invention relates to an improved leafless gutter design.

Thus, in a first form, the present invention provides a modular guttering assembly or kit comprising:

at least one gutter portion having a top trough located above a bottom trough; and at least one further guttering component having connection means allowing a plug and socket connection between the gutter portion and the further guttering component.

The further guttering component may be a further gutter portion, a connector or an end member.

The gutter portion or the connector, preferably the latter, may have means for attachment to a support surface. The attachment means may be lugs projecting from the connector member for fastening to the support surface. The top trough of the gutter portion is preferably integrally formed with the bottom trough such that the top and bottom troughs form upper and lower walls respectively of a tubular gutter portion. This has been found to increase the sectional strength of the gutter and allow the gutter assembly to be supported via the connector members without the need for intermediate brackets. Preferably the cross-sectional shape of the gutter is substantially constant to allow the use of standard connectors.

The gutter portions are preferably attached to the connector member by means of sockets and/or spigots on the connector which receive or are received in the ends of gutter portions. The use of spigots is preferred. The connectors preferably have top and bottom troughs, with the top troughs of the gutter portions abutting against the top trough of the connector when the gutter portions are attached to the connector. The top troughs of the gutter portions and connector preferably form a substantially continuous collection surface for runoff.

The gutter portions and/or the connector, preferably at least the latter, may have apertures which allow at least part of the runoff to be diverted to the bottom trough. The apertures may contain strainer members adapted to retain any debris in the top trough.

In a further form, the invention provides a gutter comprising:

a bottom trough having an outlet, and a top trough covering the bottom trough, the top trough being adapted to initially receive runoff and to divert the runoff to apertures in communication with the bottom trough, the apertures being fitted with strainer members.

The top trough preferably has a substantially smooth concave surface which may slope downwardly from a rear uppermost portion to a central lowermost portion. Apart from the apertures and the strainer members, the gutter preferably has a substantially constant cross-sectional shape throughout its length.

Figure 2:
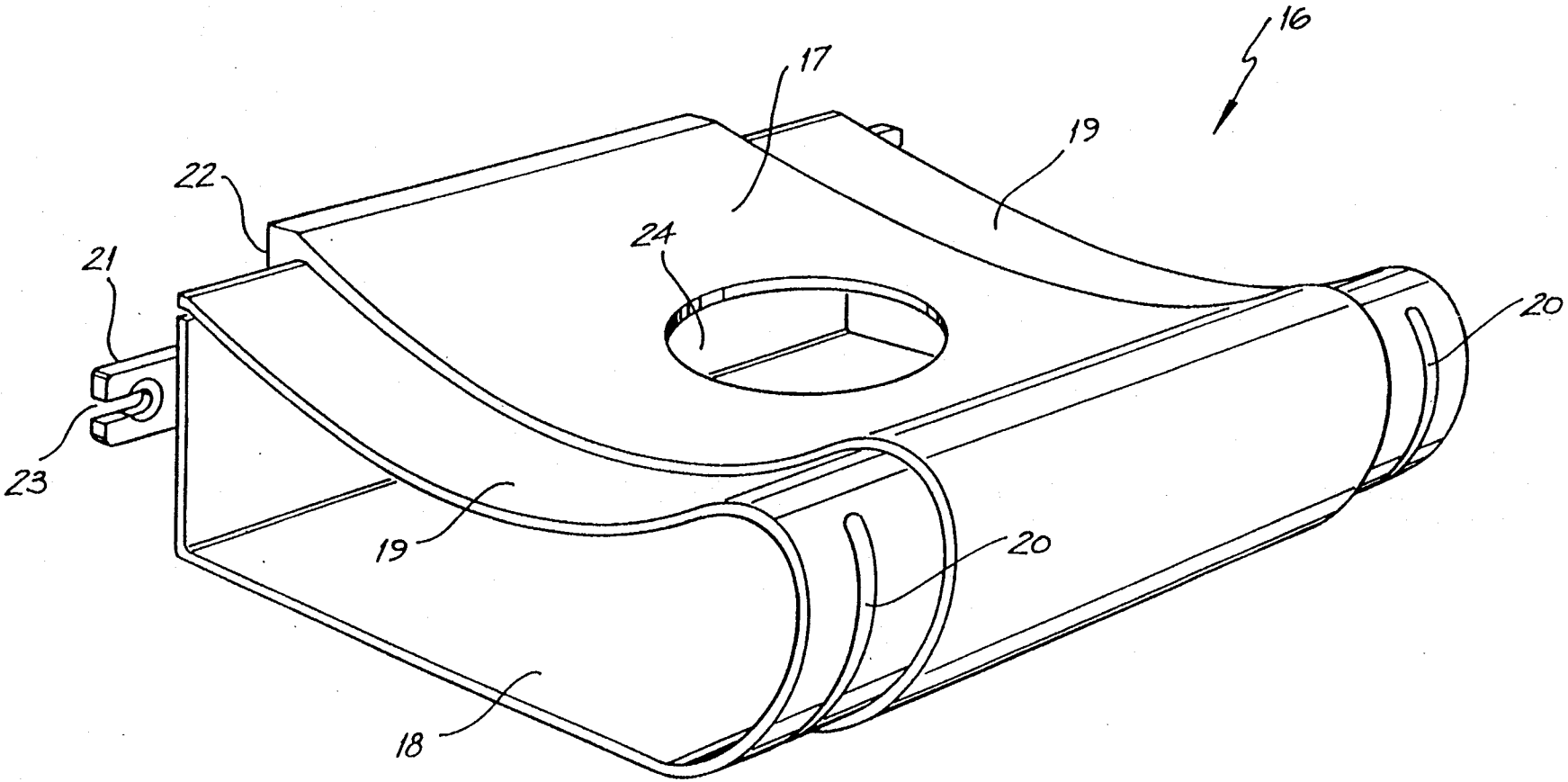

Preferred embodiments of the present invention shall now be further described with reference to the accompanying drawings, in which:

FIG. 1 is a expanded perspective view of a gutter assembly according to the present invention; and FIG. 2 is a perspective view of the connector in FIG. 1.

The gutter assembly of FIG. 1 includes gutter portions 11 having top 12 and bottom 13 troughs, joined by a rear wall 14 and front wall 15. The front wall may be shaped to give aesthetic appeal or to receive a decorative gutter fascia. The gutter portions 11 in FIG. 1 are shown having a reduced length. In practice, the length of each gutter portion could vary but would usually be in the range of from one to three meters.

Adjacent gutter portions 11 are joined by connectors 16 shown in more detail in FIG. 2. Each connector has top and bottom troughs 17, 18 and spigots 19 generally shaped to conform to the inner surface of the gutter portions, and may be provided with grooves 20 for retaining seals (not shown). Lugs 21 extend from the rear wall 22 of the connectors to beyond the spigots 19 and incorporate a slotted screw hole 23.

The top troughs 17 of the connectors 16 have apertures 24 communicating with the region above the bottom trough 18 and each aperture is fitted with a strainer 25. The illustrated strainer is dome-shaped and has a series of slots 26 which permit water to pass through the aperture but retain any debris in the top trough. Locating arms 27 extend beyond the diameter of the strainer to prevent it falling through the aperture 24 and a locating wedge 28 inhibits accidental dislodgement of the strainer. The top troughs 12 of the gutter portions 11 may also have apertures fitted with strainers. The longitudinal spacing between adjacent apertures would usually be in the range of 0.2 to 2.5 meters.

The gutter portions 11 are joined to the connector 16 simply by sliding the end of the gutter portions over spigot 19 until the top troughs 12 of the gutter portion abut against the top trough 17 of the connector to form a substantially continuous collection surface. Of course, additional gutter portions and connectors may be used according to the length of gutter required. An-end cap 29 having a similar profile to the gutter portions 11 but including an end wall 30 projecting above the top trough, and connectors and including a downwardly projecting spigot (not shown) or other means for attachment to fittings may be added to complete the gutter assembly. FIG. 1 also illustrates an external corner connector 31 for use in the guttering system.

In use, the gutter assembly is mounted on a fascia of a building with the edge of the roof overlying the collection surface formed by the top troughs 12, 17. Runoff from the roof initially is received by the top trough 12 and flows along that trough to the apertures 24. The water is diverted into bottom trough 13, 18 and flows along that trough to a downpipe or other outlet. The smooth upper surface of the top trough 12, 17 allows the wind continually to dislodge leaf debris from the top trough, thus reducing the need for manual cleaning.

The gutter assembly components may be made of any suitable material such as PVC, aluminium or steel and may be formed by any suitable process, for example extrusion, roll-forming or die-casting.

While particular embodiments of this invention have been described, it will be evident to those skilled in the art that the present invention may be embodied in other specific forms without departing from the essential characteristics thereof. For example, the need for connector members may be negated by forming gutter portions having a socket at one end to directly receive an end of an adjacent gutter portion. The present embodiments and examples are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. Roof guttering comprising a bottom trough, a substantially smooth concave top trough covering the bottom trough, the top and bottom troughs together forming a substantially tubular section, means for attachment of the guttering to a roof structure, wherein the top trough is shallow and has a plurality of aperture spaced along the length thereof, the apertures being fitted with strainer members, such that runoff received by the top trough flows therealong to the apertures and is diverted through the apertures to the bottom trough and flows to an outlet while debris in the runoff is retained on the top trough by the strainer members.

2. Guttering according to claim 1 wherein said top trough has a surface which in transverse cross section slopes downwardly from a rear uppermost portion to a central lowermost portion.

3. Guttering according to claim 2 wherein the apertures are provided at longitudinally spaced locations along said central lowermost portion of the top trough.

4. Guttering according to claim 3 wherein the apertures are spaced at intervals of from 0.2 to 2.5 meters.

5. Guttering according to claim 1 wherein the guttering has a substantially constant cross-sectional shape throughout its length.

6. Guttering according to claim 5 wherein the top trough is integrally formed with the bottom trough.

7. Guttering according to claim 1 comprising a plurality of tubular gutter portions each comprising a bottom trough and a substantially smooth top trough covering the bottom trough, a connector which has said means for attachment of the guttering to a roof structure, adjacent gutter portions being connected by plug and socket connections to said connector.

8. Guttering according to claim 7 wherein the connector has top and bottom troughs in fluid communication with the respective troughs of the gutter portions.

9. Roof guttering comprising a bottom trough, a substantially smooth concave top trough covering the bottom trough, the top and bottom troughs together forming a substantially tubular section, means for attachment of the guttering to a roof structure, wherein the top trough has a plurality of apertures spaced along the length thereof, the apertures being fitted with strainer members, such that runoff received by the top trough flows therealong to the apertures and is diverted through the apertures to the bottom trough and flows to an outlet while debris in the runoff is retained on the top trough by the strainer members, said guttering including a plurality of tubular gutter portions each having a bottom trough and a substantially smooth top trough covering the bottom trough, a connector which has said means for attachment of the guttering to a roof structure, said connector having top and bottom troughs in communication with the respective troughs of the gutter portions, adjacent gutter portions being connected by plug and socket connections with the respective troughs of the gutter portions.

10. Roof guttering comprising a plurality of tubular gutter portions each comprising a bottom trough and a shallow substantially smooth concave top trough covering the bottom trough, the top and bottom troughs together forming a substantially tubular section, means for attachment of the guttering to a roof structure, wherein the top trough has a plurality of large apertures spaced along the length thereof, the apertures being fitted with strainer members, such that runoff received by the top trough flows therealong to the apertures and is diverted to the bottom trough and flows to an outlet while debris in the runoff is retained on the smooth concave top trough by the strainer members for subsequent drying and removal of the debris by the wind, further comprising a connector which connects adjacent gutter portions, said connector having top and bottom troughs in fluid communication with the respective troughs of the gutter portions.

11. Roof guttering comprising a bottom trough, a substantially smooth concave top trough covering the bottom trough, the top and bottom troughs together forming a substantially tubular section, means for attachment of the guttering to a roof structure, wherein the top trough is shallow and has a plurality of apertures spaced along the length thereof with substantial unapertured areas lying between adjacent apertures, the apertures being fitted with strainer members, such that runoff received by the top trough flows therealong to the apertures and is diverted through the apertures to the bottom trough and flows to an outlet while debris in the runoff is retained on the top trough by the strainer members.

* * * * *

UNITED STATES PATENT AND TRADEMARK OFFICE

CERTIFICATE OF CORRECTION

PATENT NO. : 5,435,105

DATED : July 25, 1995

INVENTOR(S) : TIMON J. VISSER

It is certified that error appears in the above-indentified patent and that said Letters Patent is hereby corrected as shown below:

On the title page, item [73] the spelling of the assignee's name should be as follows:

VISSHILL-TECH (PATENTS) PTY. LIMITED

Signed and Sealed this

Twentieth Day of February, 1996

*Attest:*

*Attesting Officer*

Bruce Lehman

BRUCE LEHMAN

*Commissioner of Patents and Trademarks*